US005335916A

United States Patent [19]

Nee

[11] Patent Number: 5,335,916

[45] Date of Patent: Aug. 9, 1994

[54] FINGERLESS PALM GLOVE

[76] Inventor: Victor Nee, 1624 Arcadia, South Bend, Ind. 46635

[21] Appl. No.: 883,691

[22] Filed: May 15, 1992

[51] Int. Cl.[5] ..... A63B 71/14; A41D 19/00

[52] U.S. Cl. ..... 273/346; 2/161.1; 2/161.4; 273/412; 273/DIG. 30

[58] Field of Search ..... 273/412, 346, DIG. 30; 2/19, 20, 159, 161 A

[56] References Cited

U.S. PATENT DOCUMENTS 660,886 2/1968 Bryan ..... 2/159
3,369,258 2/1968 Smith ..... 2/159
3,953,030 4/1976 Muchnick ..... 273/346
4,138,108 2/1979 Robinson ..... 273/54 B
4,531,241 7/1985 Berger ..... 2/20 X

*Primary Examiner*—William H. Grieb
*Attorney, Agent, or Firm*—James D. Hall

[57] ABSTRACT

Fingerless palm glove used in a game of catch including a hand wrap for covering the palm of the wearer while allowing the free movement of the digits and having a hook material section for use in association with a ball covered in a loop material.

2 Claims, 5 Drawing Sheets

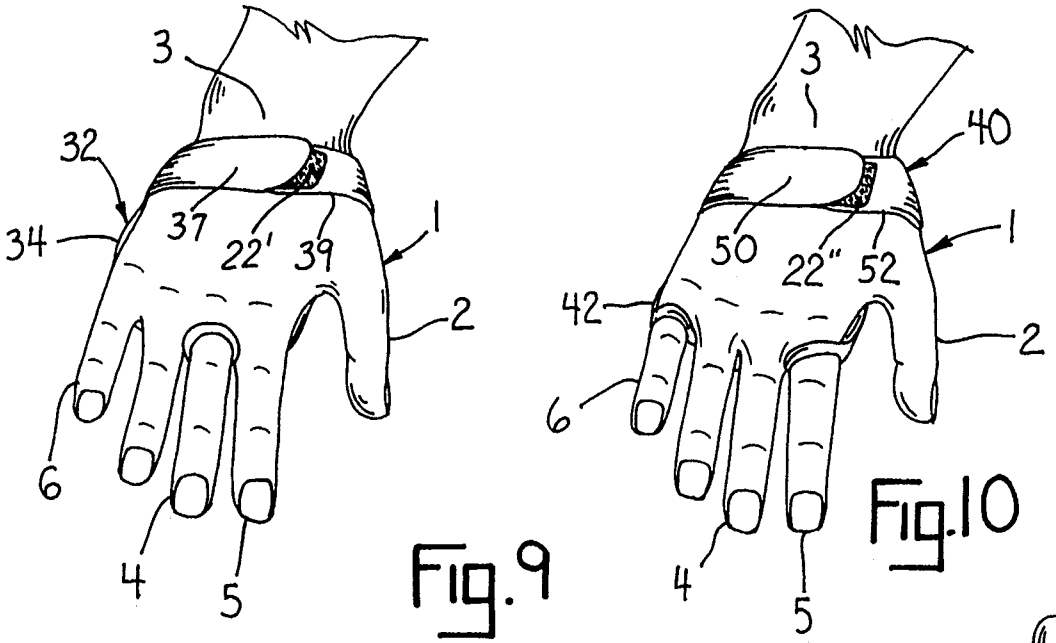
Fig. 9
Fig. 10
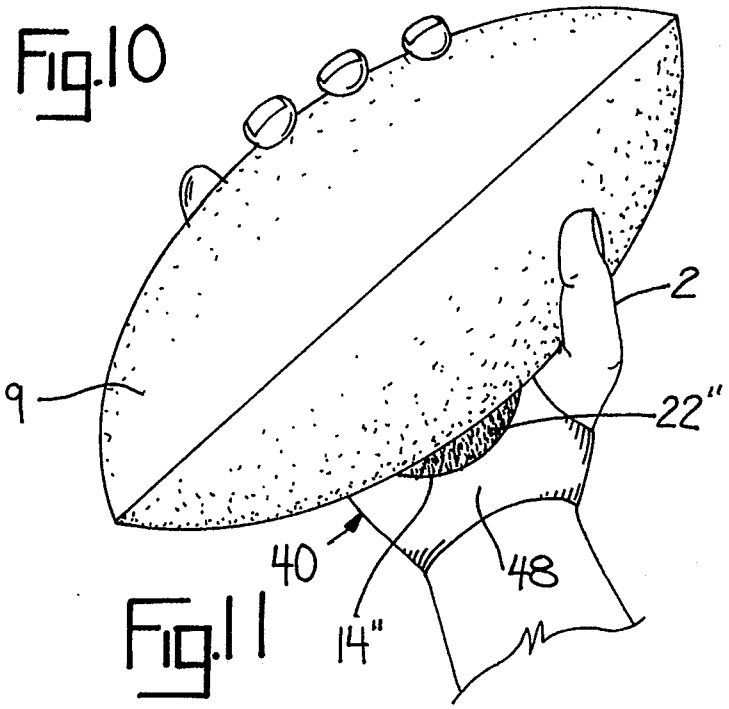
Fig. 11

FINGERLESS PALM GLOVE

FIELD OF THE INVENTION

This invention relates to improvements in the area of gloves, and will have special application to sports gloves which are used in the game of catch. The invention will have additional applications in the area of fingerless protective glove.

SUMMARY OF THE INVENTION

Catching an object projected through the air requires a fair amount of coordination and can be extremely difficult for young or handicapped people. The modern baseball glove and other similar sports gloves have decreased the required skill level by modifying and increasing the surface area available to receive the various projected objects. The motor skills necessary to grasp the object upon receipt, however, remains a problem for the young and handicapped. This invention eliminates some of the coordination and motor skills required to catch an object.

This invention utilizes hook and loop materials, such as VELCRO®, strategically placed at the palm of a fingerless glove and on the covering of the projectile, such as a ball, or football. Hook and loop materials have been utilized in many ways to allow the adherence of one object to another. Further, hook and loop materials have also been utilized specifically in throwing games. For example, the game of catch in which participants utilize a paddle covered with VELCRO®, and a loop material ball have become popular. Similarly, hook patches have been placed within common leather baseball gloves. However, this invention is novel in that the hook material is placed on a wrap which is secured to the hand but leaves the fingers free. Therefore, participants could both catch and throw with the same hand without having to catch the ball in the gloved hand and throw the ball with the other hand. If desired each hand can be gloved. The fingerless glove thus enhances comfort and mobility.

It is an additional object of this invention to create a glove which can be worn on either hand and is economical, lightweight and adaptable. In accordance with this object, this invention is created out of a material which accomplishes this result and allows for the invention to be used at a beach, in a park or in the house.

Additionally, this invention may be used as a protective glove for various activity, such as cycling and weight lifting and for handicapped individuals who use a wheelchair or crutches. The invention provides protection for the palm, but leaves the fingers free.

Further objects of this invention will become apparent on a review of the following descriptions and drawings.

BRIEF DESCRIPTION OF THE DRAWINGS

FIG. 9 illustrates the glove of FIG. 5 shown placed on a hand and secured at the back of the wrist.

FIG. 10 illustrates the glove of FIG. 6 shown placed on a hand and secured at the back of the wrist.

FIG. 11 illustrates the glove shown placed on a hand with a football attached.

DETAILED DESCRIPTION OF THE INVENTION

The preferred embodiments herein described are not intended to be exhaustive or to limit the invention to the precise forms disclosed. They are chosen and described to explain the principles of the invention and its application and practical use so that others skilled in the art may follow its teachings.

Figure 1:
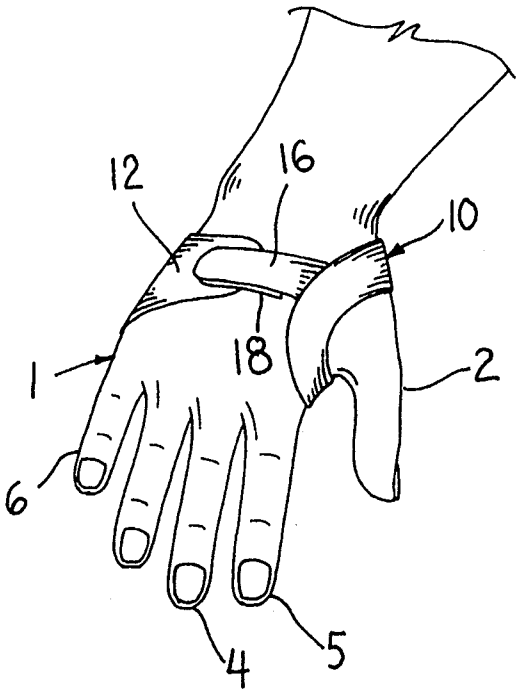
FIG. 1 is a perspective view one embodiment of the glove of this invention.

As shown in FIG. 1, glove 10 has an elongated palm covering wrap 12 with thumb hole 30 near one end. The fabric of glove 10 can be constructed from a variety of fabric materials, including cloth, leather and vinyl. The interior of glove 10 may be lined with a soft fabric for user comfort. Tabs 16 and 18 extend from each end of wrap 12. Tab 16 carries loop material 20 on its interior face. Tab 18 carries hook material 22 on its exterior face. Palm patch 14 cover the center portion of the exterior surface of wrap 12. FIGS. 1, 3–8 and 11 shows a palm patch 14 being constructed of hook material 22; however, it should be known that a looped material or a section of padding may be used depending on the glove function application.

Figure 2:
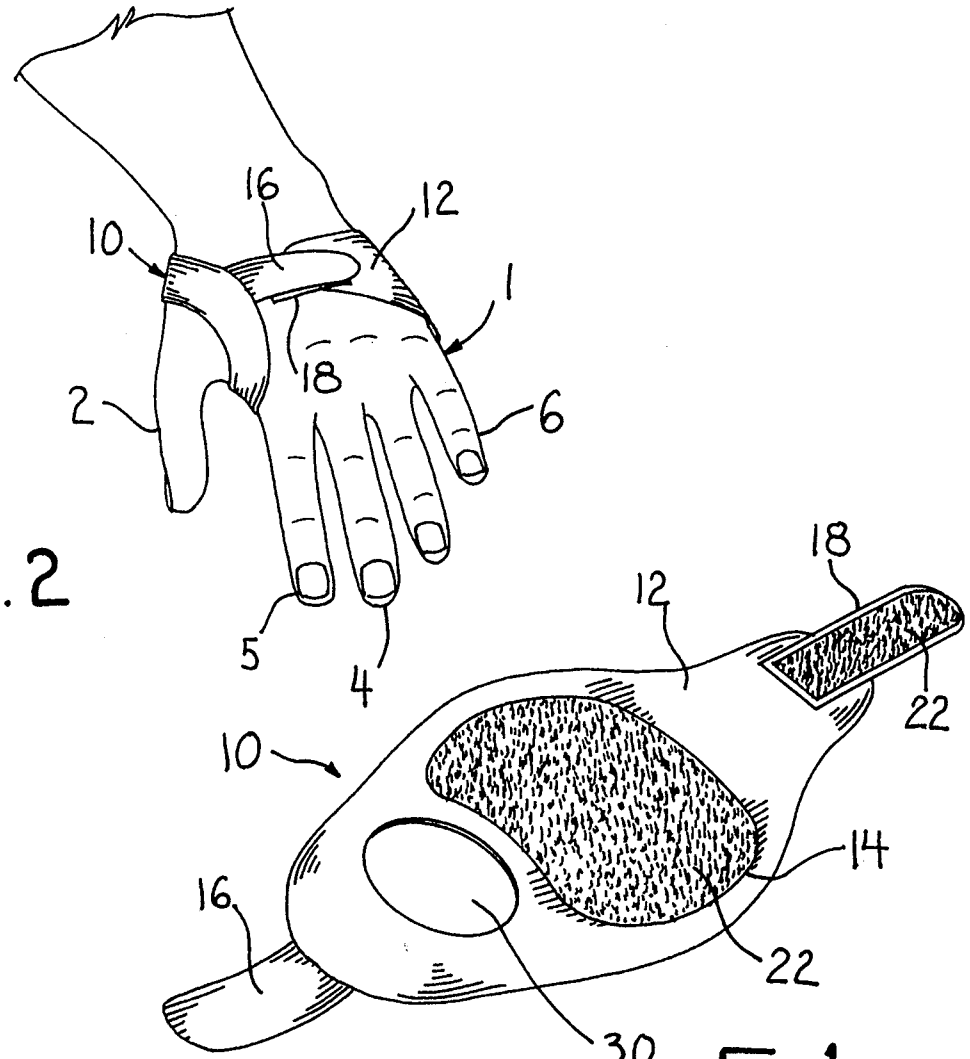
FIG. 2 illustrates the glove shown placed on each hand and secured at the back of the hands.
Figure 3:
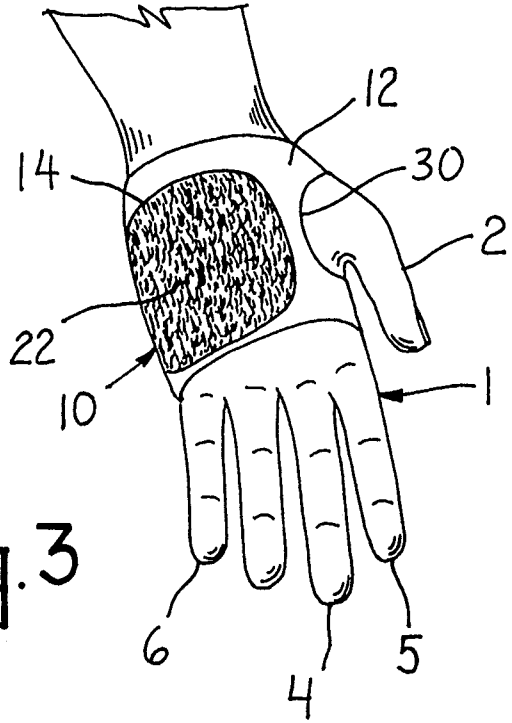
FIG. 3 illustrates the glove shown placed on each hand as seen from the palm side of the hand.
Figure 4:
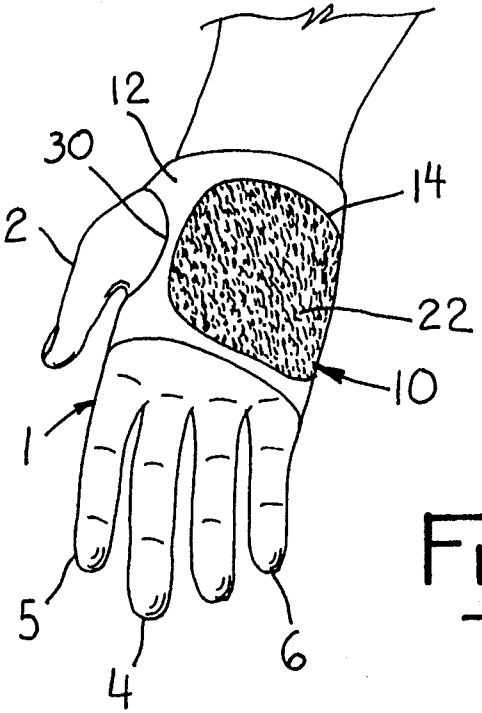
FIG. 4 illustrates the glove shown placed on a hand with a round ball attached.
Figure 4:
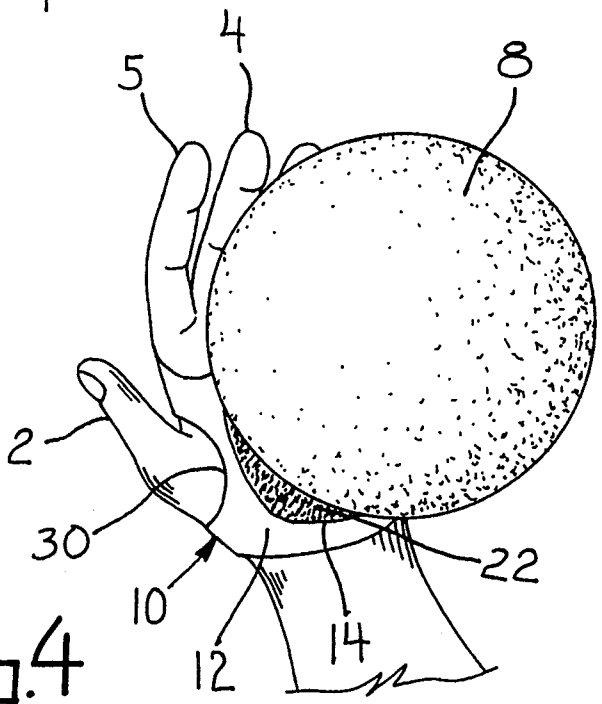

FIGS. 2–4 illustrate the use of glove 10 as embodied in FIG. 1. In use, the wearer places thumb 2 through hole 30 with the interior of wrap 12 facing the wearer's palm. Wrap 12 is firmly folded around hand 1 as shown in FIGS. 2 and 3. Wrap 12 is secured about hand 1 and by engaging tabs 16 and 18 over the back of hand 1. Tabs 16 and 18 are secured by pressing the loop material 20 on the interior of tab 16 to the hook material 22 at its exterior of tab 18. In this manner, palm patch 14 of glove 10 covers the palm of hand 1, while the finger remains uncovered and free.

Figure 6:
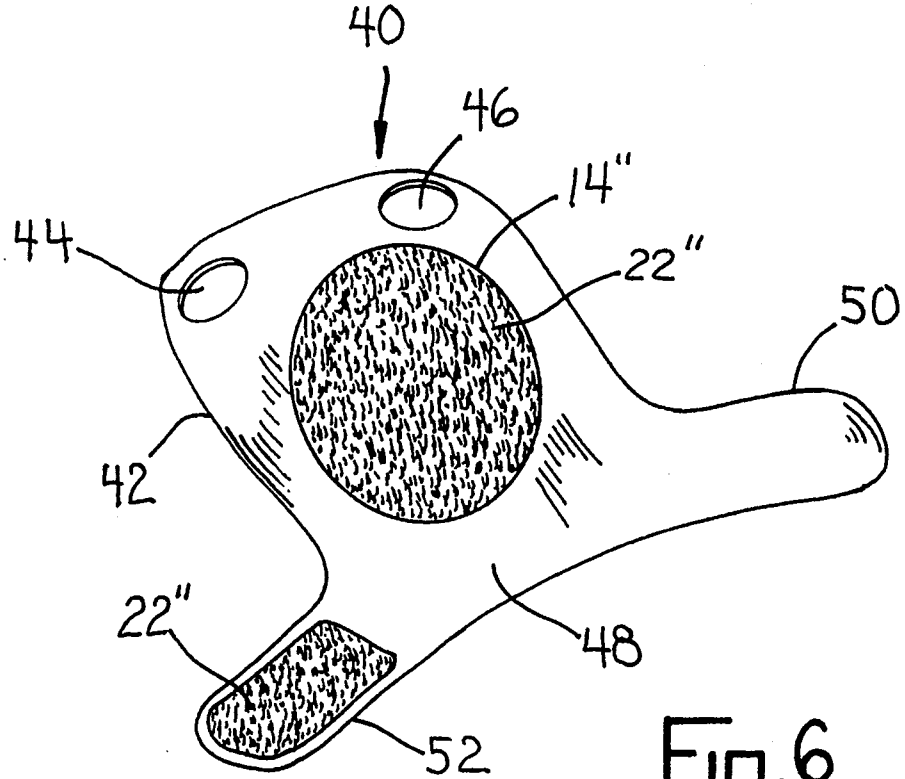
FIG. 6 illustrates a second embodiment of said glove having two opening for an index and little fingers and an extension for a wrist wrap closure.
Figure 5:
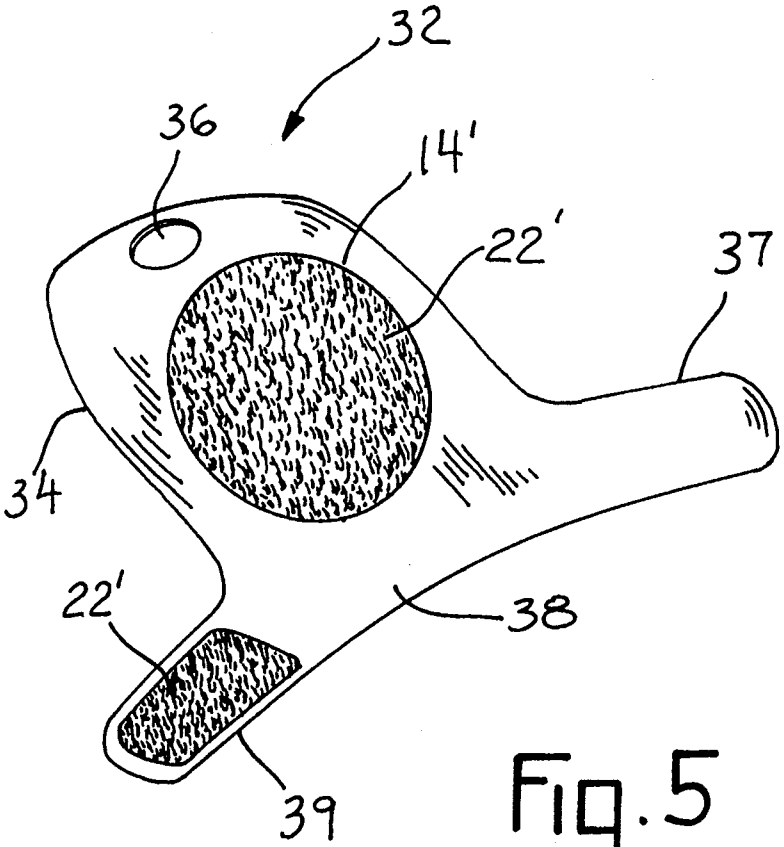
FIG. 5 illustrates a third embodiment of said glove having an opening for a middle finger an extension for a wrist wrap closure.
Figure 7:
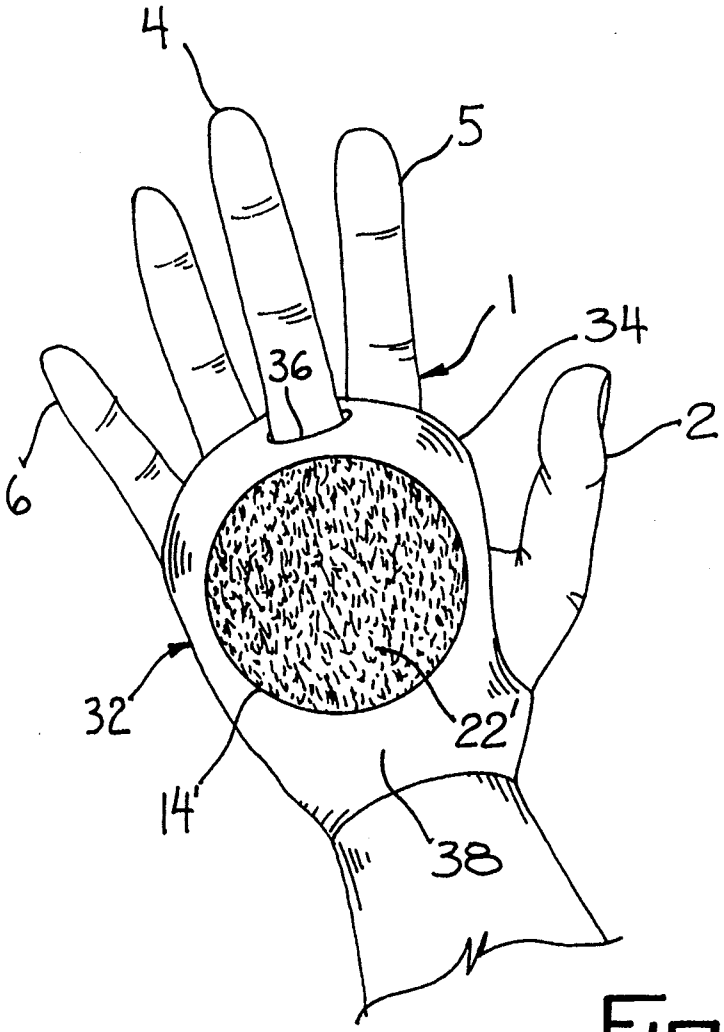
FIG. 7 illustrates the glove of FIG. 5 shown placed on a hand as seen from the palm side of the hand.

FIGS. 5 and 6 shows other embodiments of the glove of this invention. In FIG. 5, glove 32 includes a wrap 34 which uses a single finger hole 36. The wearer places middle finger 4 through finger hole 36 as seen in FIG. 7. This embodiment secures across the back of the wrist as seen in FIG. 9. Wrist wrap 38 extend from wrap 34 opposite finger hole 36. Tabs 37 and 39 extend from the ends of wrist wrap 38 to secure wrap 34 around the back of the wrist. Tabs 37 and 39 are secured by loop material 20' and hook material 22'. Palm patch 14' shown to be hook material 22', covers the center portion of the exterior surface of wrap 34.

Figure 8:
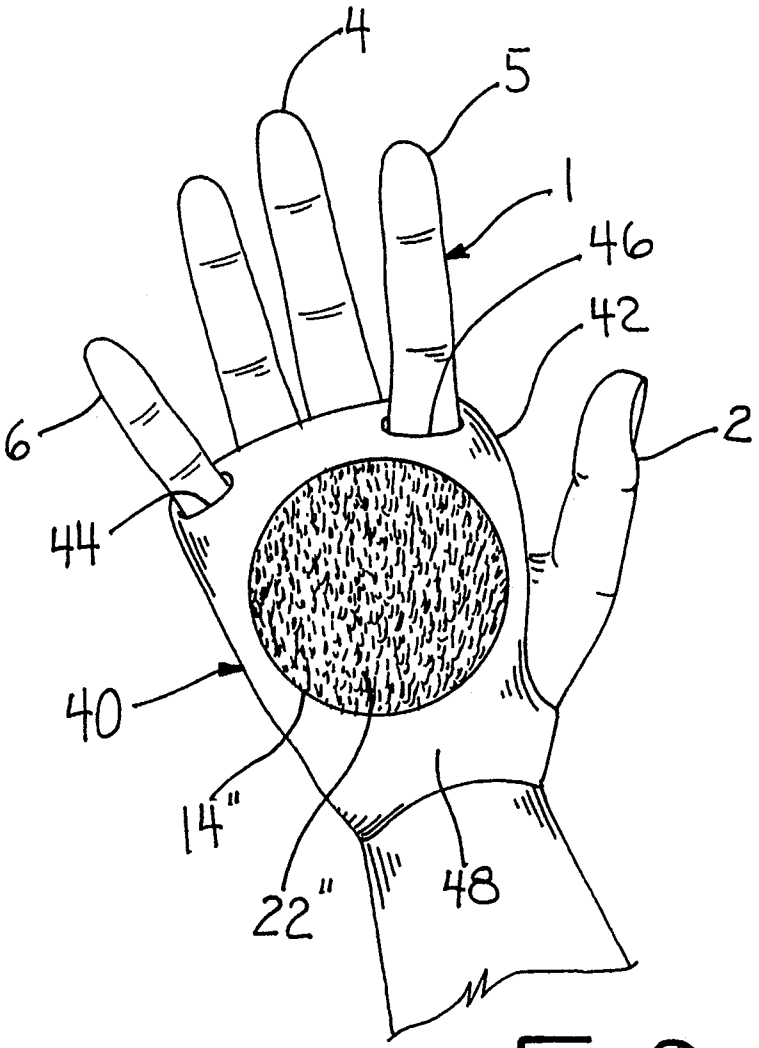
FIG. 8 illustrates the glove of FIG. 6 shown placed on a hand as seen from the palm side of the hand.

In the embodiment of FIG. 6, glove 40 includes a wrap 42 which uses two finger holes 44 and 46. The user places index 5 and little finger 6 in finger holes 44 and 46 as seen in FIGS. 8 and 10. Wrist wrap 48 extends from wrap 42 opposite finger holes 44 and 46. Tabs 50 and 52 extend from the ends of wrist wrap 38. FIG. 10 shows tabs 50 and 52 secured across the back of wrist 3. Tabs 50 and 52 are secured by loop material 20″ and hook material 22″. Palm patch 14″, shown to be of hook material 22″, covers the center portion of the exterior surface of wrap 48. In all embodiments, gloves 10, 32 and 40 can be worn on either hand because of the configuration of the wrap and finger openings.

The ball used in the game of catch would be covered with a looped material 20. FIG. 4 and 11 show the use with a round ball 8 and a football 9. With the glove snugly placed on either or both of two participants hands, a round ball 8 or a football 9 is thrown by one participant toward another participant. The receiving participant catches the ball with the engagement of the loop material 20 of the ball contacting the hook material 22, 22′, 22″ of the palm patch 14, 14′, 14″ of glove 10, 32, 40. With the participant fingers being free of the glove, the receiver can free the ball from the glove and throw the ball back with the same gloved hand.

Using padding materials for the palm patches instead of the hook material, the glove can assume a variety of other uses. For example, with a padded palm patch, the glove can be used for cycling, weight lifting, rowing or other activity that demand padding and protection to the palms.

The above disclosure and description is purely illustrative and various changes of size and material may be made without changing the scope of the claims.

I claim:

1. In combination, a fingerless glove to cover the palm of the user's hand for use in a game of catch comprising a hand wrap constituting means for overlying the palm of either hand of said user having an inner face adapted to lie against said user's palm and an outer face with a central patch constructed of a hook material carried upon said outer face, said wrap having opening means for receiving at least one digit of said user's hand, fastening means for securing said wrap to said user's hand, and means for use as a projectile in said game of catch with an outer covering constructed of a loop material, wherein said object is received by said glove and clasped by the engagement of said outer covering of said object to said patch of said wrap.

2. A fingerless glove to cover the palm of the user's hand for use in a game of catch comprising a hand wrap constituting means for overlying the palm of either hand of said user, said wrap having enclosed opening means for encircling at least one of said fingers of said user's hand to anchor said wrap over the palm, and fastening means spaced from said opening means for securing said wrap about the back of said user's hand, said wrap having a palm shaped body with said fastening means including oppositely extending wrist encircling portions located along the lower margin of said body, said opening means being located opposite said wrist portions along the upper margin of said body for receiving at least one of said user's fingers excluding the user's thumb, said wrist portions including attachment means for connective engagement across the back of said user's wrist.

* * * * *